US007264312B1

(12) United States Patent
Wang

(10) Patent No.: US 7,264,312 B1
(45) Date of Patent: Sep. 4, 2007

(54) BACKREST ADJUSTING MECHANISM

(76) Inventor: Chih Chiang Wang, 2F, No. 3, Lane 280, Chung-Chan Road, Hsien Tien City, Taipei Hsien (TW) 231

( * ) Notice: Subject to any disclaimer, the term of this patent is extended or adjusted under 35 U.S.C. 154(b) by 0 days.

(21) Appl. No.: 11/434,842

(22) Filed: May 17, 2006

(51) Int. Cl.
*A47C 7/40* (2006.01)

(52) U.S. Cl. ..... 297/353; 297/383

(58) Field of Classification Search ..... 297/353, 297/383

See application file for complete search history.

(56) References Cited

U.S. PATENT DOCUMENTS 3,720,442 A * 3/1973 Bergmann et al. ..... 297/344.18
4,102,549 A * 7/1978 Morrison et al. ..... 297/383
4,536,031 A * 8/1985 Latone ..... 297/353
5,511,852 A * 4/1996 Kusiak et al. ..... 297/301.4
5,882,077 A * 3/1999 Gebhard ..... 297/353
6,619,745 B2 * 9/2003 Roberts et al. ..... 297/383
6,659,560 B1 * 12/2003 Chi ..... 297/383

* cited by examiner

*Primary Examiner*—Milton Nelson, Jr.

(57) ABSTRACT

A backrest adjusting mechanism is angularly disposed between a backrest and a seat of a chair, and includes a main support slidably received in a sleeve member, and a locating gear. The main support is provided on a middle lower surface with a downward projected limiting element and on a middle upper surface with an elastically upward protruded locating element. The sleeve member is provided on a lower surface with a lengthwise guide slot for the limiting element to slide therein, and on an upper surface with locating recesses for the elastic locating element to slide thereinto and hold the main support to an adjusted position. The locating gear includes a shaft turnably extended across the sleeve member, so that a press lug of at least one brake element on the shaft may be turned to firmly press against and hold the main support in place at the adjusted position.

8 Claims, 7 Drawing Sheets

BACKREST ADJUSTING MECHANISM

FIELD OF THE INVENTION

The present invention relates to a backrest adjusting mechanism, and more particularly to a backrest adjusting mechanism that can be conveniently operated by a user to easily and quickly adjust the height and distance of a backrest relative to a seat of a chair according to the user's figure.

BACKGROUND OF THE INVENTION

Most desk chairs with a relatively simple structure have a backrest immovably connected to a seat. That is, the backrest is not adjustable relative to the seat, and therefore might not be able to comfortably support a user's back. Some desk chairs are improved by pivotally connecting the backrest to the seat and providing at the pivotal connection with an elastic element to support the backrest, so that the backrest is allowed to elastically swing rearward when a force is applied to the backrest. This type of backrest functions like a rocking chair to support the user's back, and is more comfortable for use. However, the backrest could not always support the users' back at a most suitable position due to different figures of users. For some relatively high or short users, the backrest of a general desk chair usually does not provide good support to the back and waist. There are developed some chairs with the backrest and the seat thereof being independently adjustable. However, the user has to leave the seat to operate the chair and achieve the purpose of adjustment. This is of course inconvenient for the user to do so.

It is therefore tried by the inventor to develop a backrest adjusting mechanism to overcome the drawbacks existed in the conventional chairs.

SUMMARY OF THE INVENTION

A primary object of the present invention is to provide a backrest adjusting mechanism for changing the distance and height of a backrest relative to a seat of a chair at the same time, so that the backrest may be adjusted according to a user's figure for the user to sit on the chair in a correct and comfortable position.

Another object of the present invention is to provide a backrest adjusting mechanism that includes components available at low cost, so that the backrest adjusting mechanism may be economically manufactured.

A further object of the present invention is to provide a backrest adjusting mechanism that can be conveniently operated by a user to easily and quickly adjust the height and distance of a backrest relative to a seat of a chair without the need of leaving the seat.

To achieve the above and other objects, the backrest adjusting mechanism according to a preferred embodiment of the present invention includes a main support, which is a hollow tubular member having a first end connected to a lower end of a backrest bracket mounted to a backrest of a chair, and is provided at a middle lower surface thereof with a downward projected limiting element, and at a middle upper surface thereof with an elastically upward protruded locating element; a sleeve member, which has a first end encloses the main support and a second end opposite to the first end angularly extended to engage with two lateral sides of a seat bracket mounted below a seat of the chair, and is provided on a lower surface of the first end with a lengthwise guide slot for the limiting element on the main support to upward extend thereinto to thereby guide the main support and the sleeve member to slide relative to one another, and on an upper surface with a row of lengthwise arranged open-bottom locating recesses, so that the locating element protruded from the upper surface of the main support may elastically slide into one of the recesses to hold the main support to the sleeve member; and a locating gear, which includes a shaft having an outer end connected to a turning handle, and an inner end transversely extended through a middle section of the sleeve member, and at least one brake element mounted on a middle section of the shaft and having a press lug radially projected from one side thereof. Whereby when the shaft is turned via the turning handle, the press lug of the brake element is driven to firmly press against at least one lengthwise edge of the main support to hold the main support in place at a desired extended or retracted position relative to the sleeve member.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
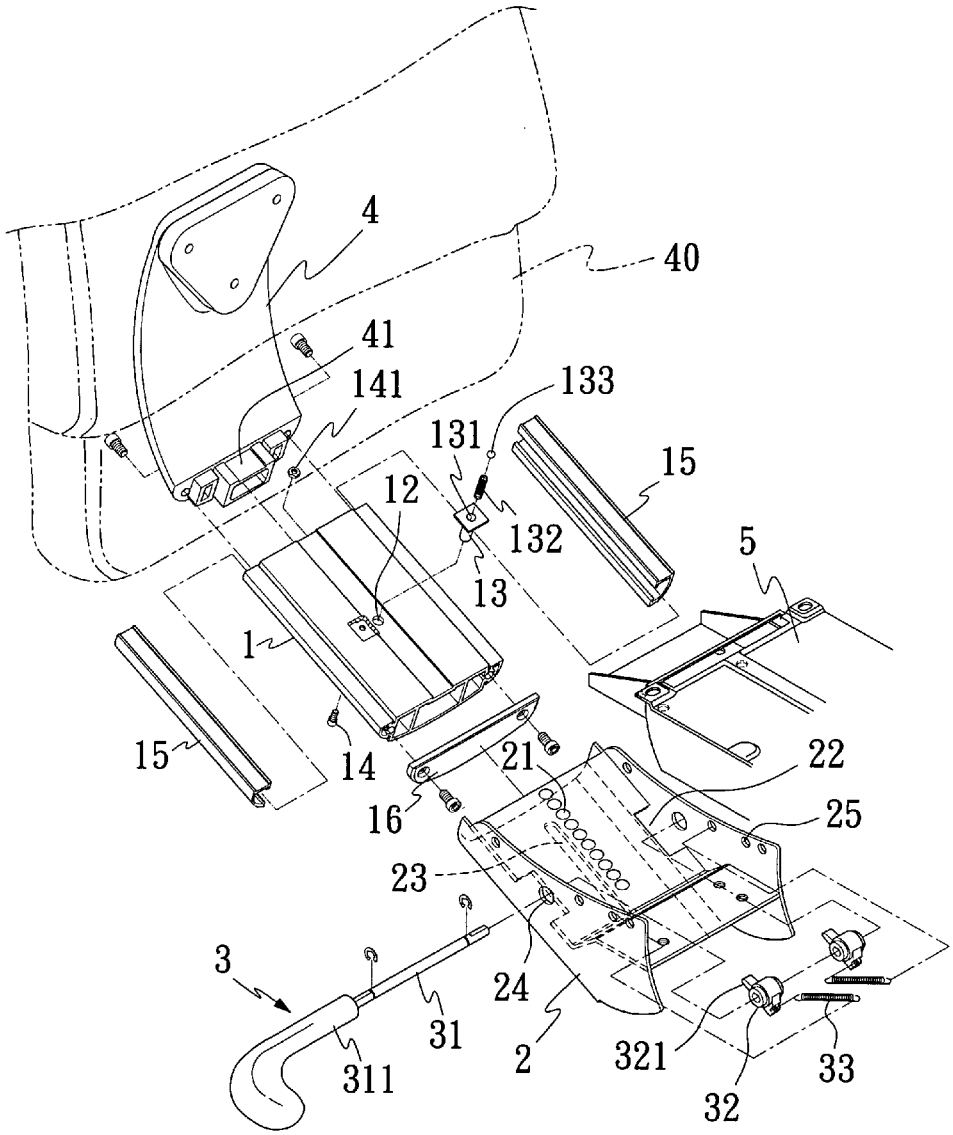
FIG. 1 is a fully exploded perspective view of a backrest adjusting mechanism according to a preferred embodiment of the present invention.
Figure 2:
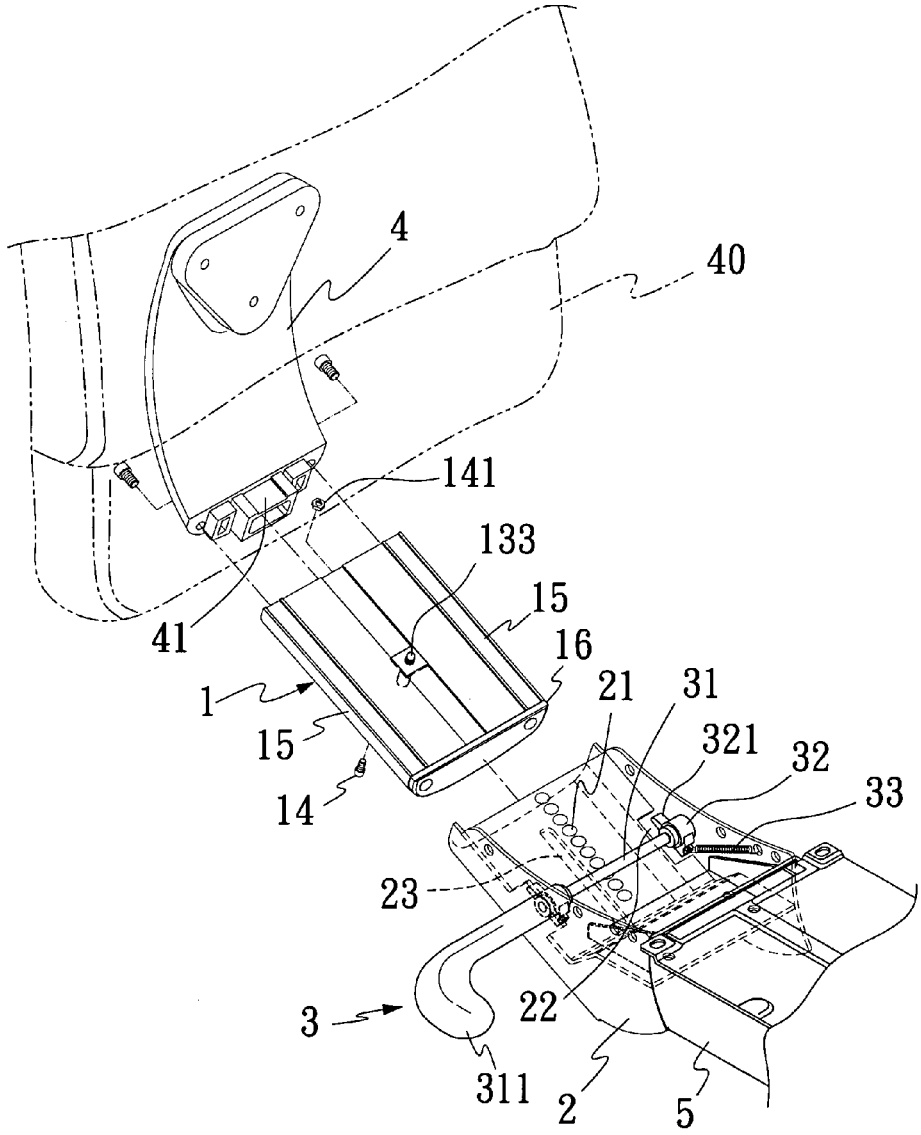
FIG. 2 is a partially assembled view of FIG. 1.
Figure 3:
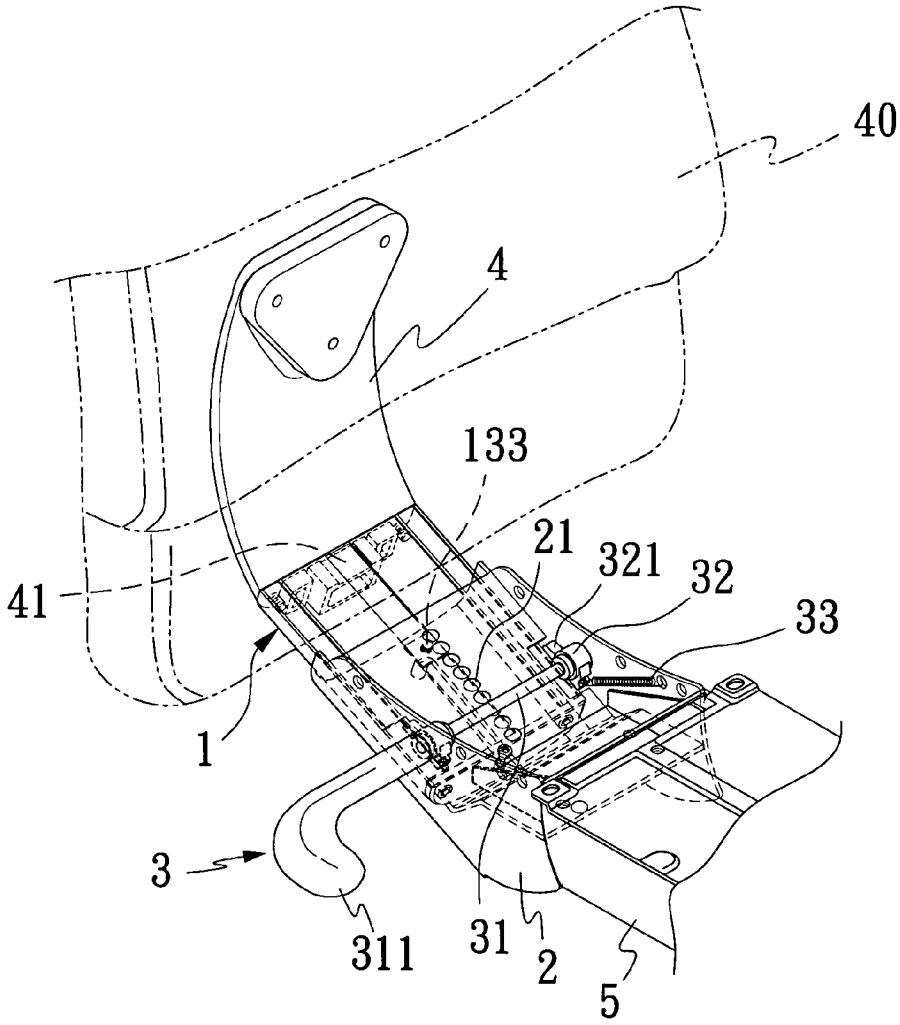
FIG. 3 is a fully assembled view of FIG. 1.

Please refer to FIGS. 1, 2, and 3 that are sequentially an exploded, a partially assembled, and a fully assembled perspective view of a backrest adjusting mechanism according to a preferred embodiment of the present invention. As shown, the backrest adjusting mechanism includes a main support 1, a sleeve member 2, and a locating gear 3.

The main support 1 is a hollow tubular member having a first end, into which a downward and forward extended projection 41 of a backrest bracket 4 is inserted, and a second end opposite to the first end closed with a cover plate 16. The main support 1 is provided at a lower surface in a middle section thereof with a through hole for a bolt 14 to upward extend therethrough to engage with a nut 141, and at an upper surface with a lengthwise groove, which is provided in a middle section with a locating hole 12 for holding a locating seat 13 thereto. The locating seat 13 is provided at a top with a cavity 131 for receiving a first elastic element 132 therein, such that the first elastic element 132 normally outward pushes a locating element 133 disposed on an outer end of the first elastic element 132. In the illustrated preferred embodiment of the present invention, the locating element 133 is a locating ball. The main support 1 also includes two coarse-surfaced antiskid strips 15 firmly attached to two lengthwise edges of the main support 1.

The sleeve member 2 has a first end enclosing the main support 1, and a second end opposite to the first end angularly extended to engage with two lateral sides of a chair seat bracket 5. The sleeve member 2 is provided at a lower surface of the first end with a lengthwise guide slot 23, such that the nut 141 in the main support 1 may upward extend into the guide slot 23 to guide the main support 1 and the sleeve member 2 to slide relative to one another. The sleeve member 2 is provided on two side walls at positions above an upper surface of the sleeve member 2 with a through bore 24 each, and on the upper surface corresponding to the two through bores 24 with two cuts 22. The sleeve member 2 is also provided on the upper surface along a sliding path of the locating element 133 with a row of lengthwise arranged open-bottom locating recesses 21.

The locating gear 3 includes a shaft 31, which includes an outer end connected to a turning handle 311, and an inner end extended through the two bores 24 on the side walls of the sleeve member 2 to transversely locate the shaft 31 above a middle section of the sleeve member 2. Two brake elements 32 are spaced on a middle section of the shaft 31, and have a radially outward projected press lug 321 each. Each of the two brake elements 32 is connected at a surface point to an end of a second elastic element 33, which is connected at an opposite end to a hook hole 25 provided on the side walls of the sleeve member 2 near the second end thereof, so as to provide the brake element 32 with a restoring force.

Figure 4:
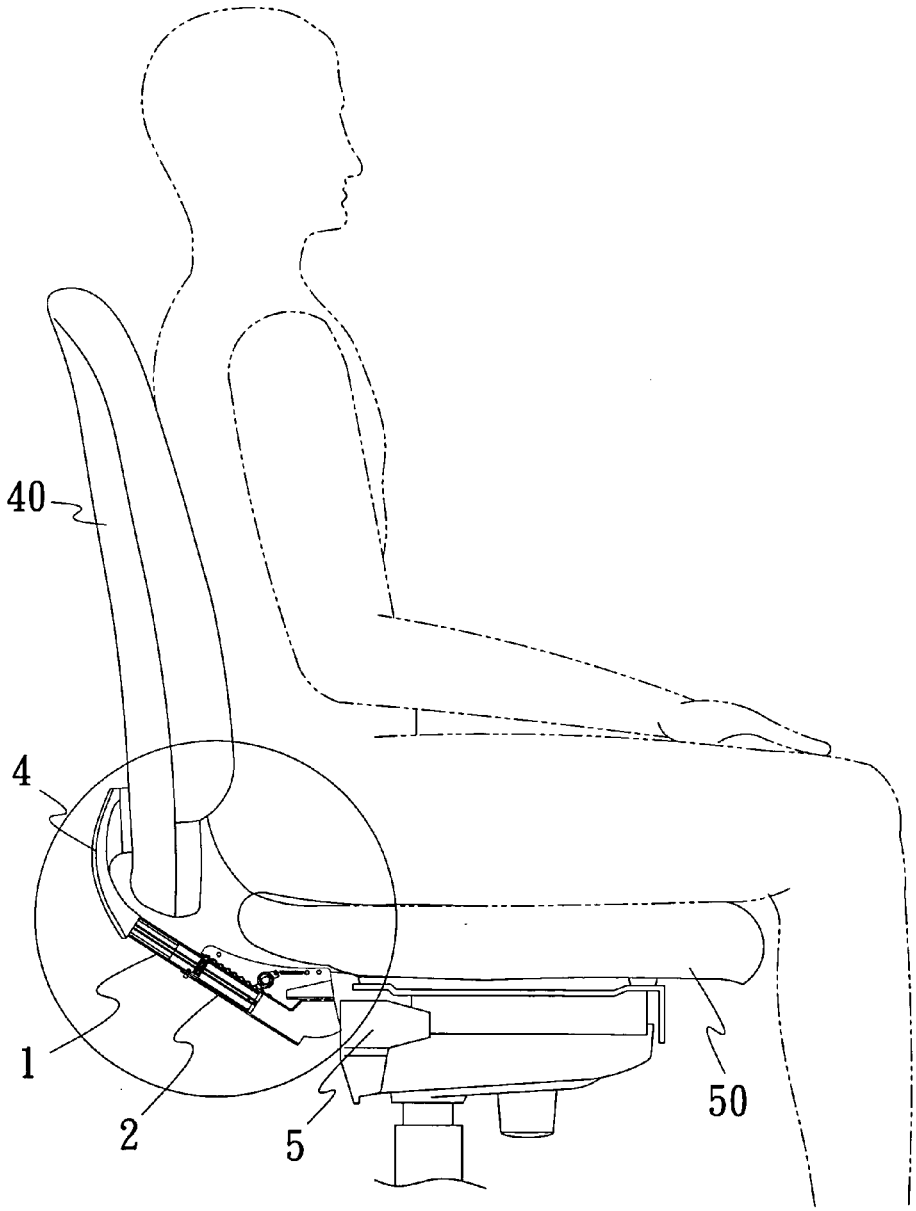
FIG. 4 is a side view schematically showing the use of the backrest adjusting mechanism of the present invention on a chair.
Figure 5:
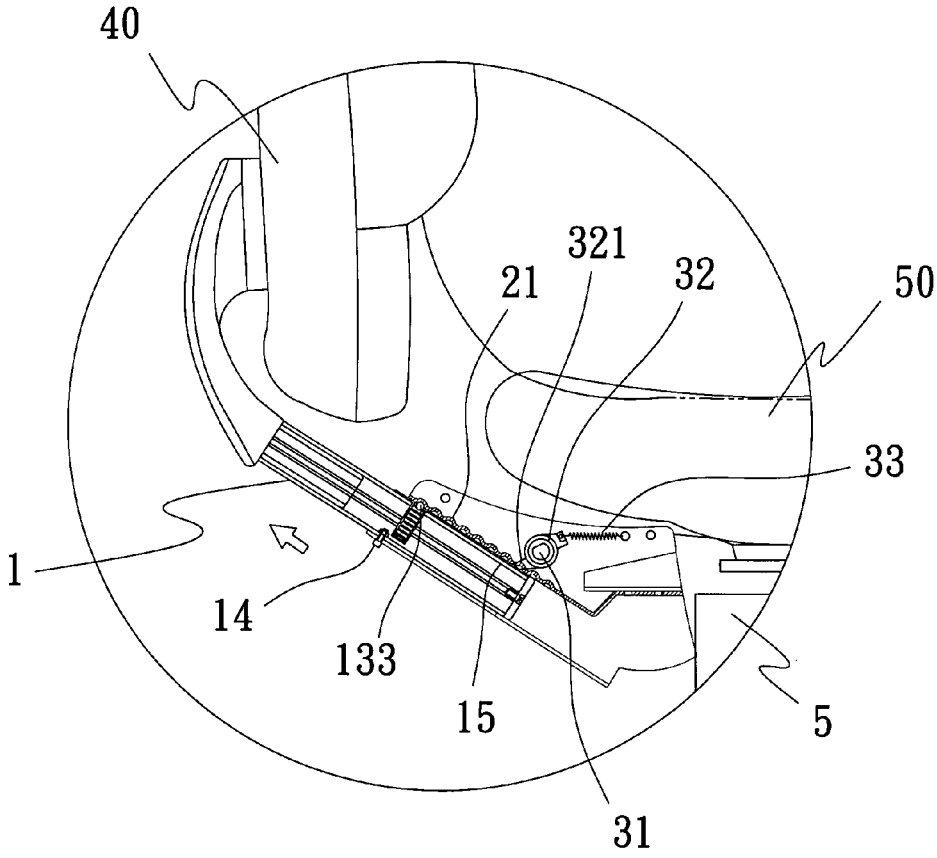
FIG. 5 is an enlarged view of the circled area of FIG. 4 showing the backrest adjusting mechanism in an extended position.
Figure 6:
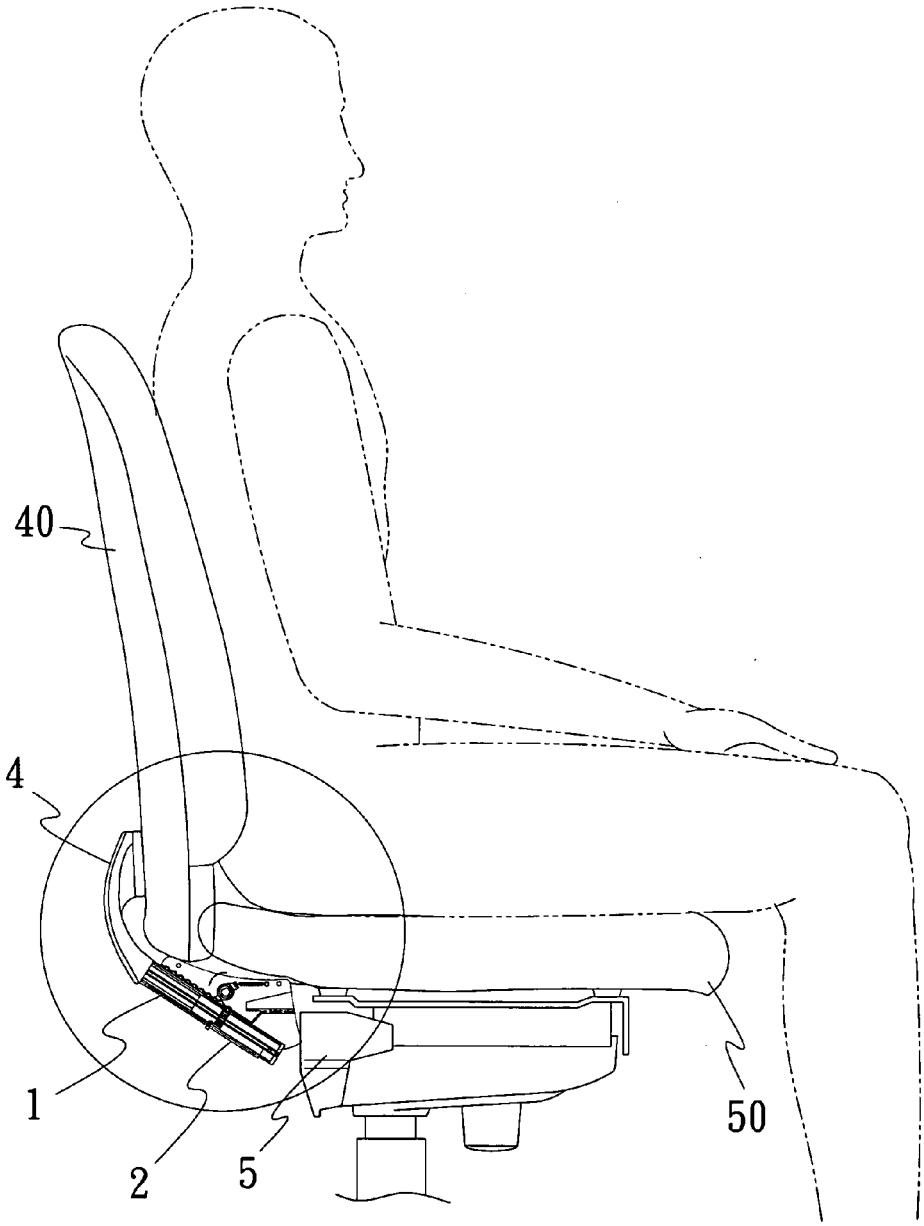
FIG. 6 is another side view schematically showing the use of the backrest adjusting mechanism of the present invention on a chair.
Figure 7:
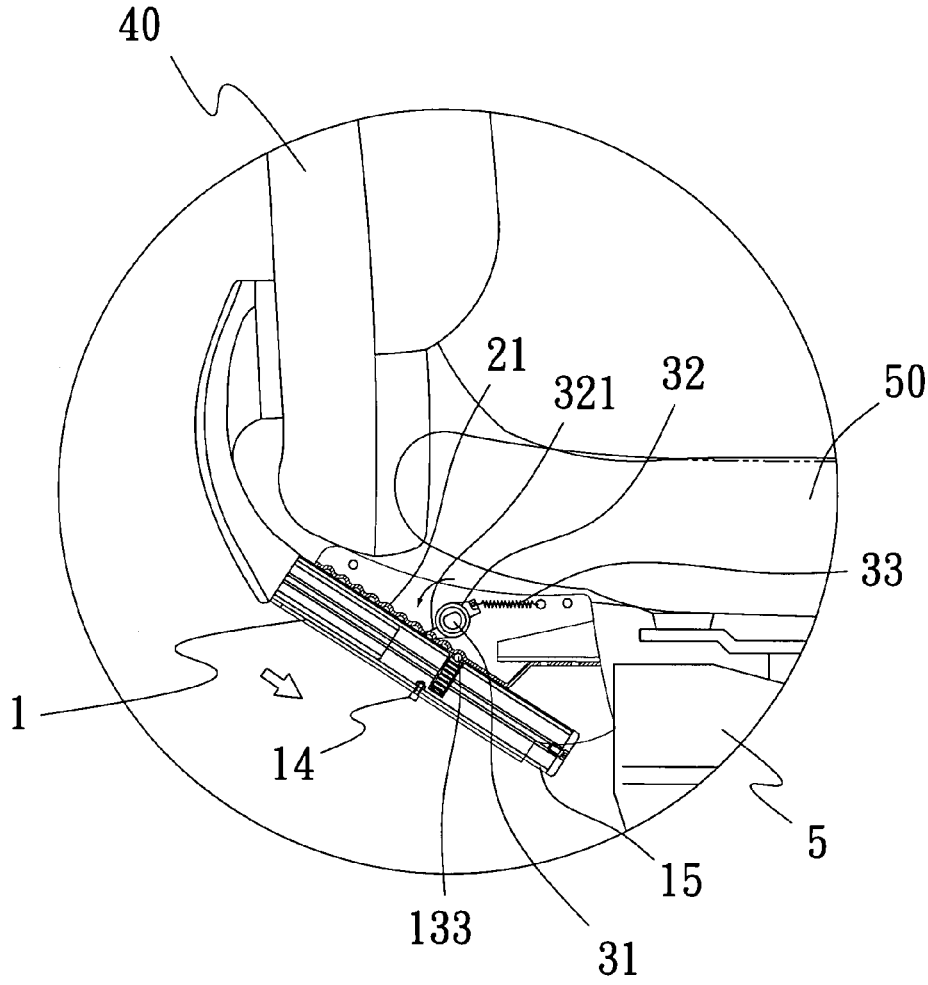
FIG. 7 is an enlarged view of the circled area of FIG. 6 showing the backrest adjusting mechanism in a retracted position.

FIGS. 4 and 6 are side views schematically showing the use of the backrest adjusting mechanism of the present invention on a chair between a back 40 and a seat 50, and FIGS. 5 and 7 are enlarged views of the circled areas of FIGS. 4 and 6, respectively. When a user adjusts a height and a distance of the back 40 relative to the seat 50 according to the user's figure, the main support 1 and the sleeve member 2 connected to the back bracket 4 on the backrest 40 and the seat bracket 5 on the chair seat 50, respectively, are brought to slide away from or toward each other. In FIGS. 4 and 5, the backrest 40 is moved upward and rearward relative to the seat 50, and the main support 1 is brought to slide away from the sleeve member 2 to an extended position; and in FIGS. 6 and 7, the backrest 40 is moved downward and forward relative to the seat 50, and the main support 1 is brought to slide into the sleeve member 2 to a retracted position.

When the back 40 is being shifted, the locating element 133 on the main support 1 is caused to elastically slide in and out of the row of locating recesses 21 on the upper surface of the sleeve member 2. And, when the back 40 is shifted to a desired position, the locating element 133 is engaged with one of the locating recesses 21 to hold the main support 1 in place in the sleeve member 2. At this point, the user may manipulate the locating gear 3 by turning the handle 311 to rotate the shaft 31 and accordingly, the two brake elements 32 mounted on the shaft 31, so that the press lugs 321 on the two brake elements 32 are brought to pass through the cuts 22 and downward tightly press against the coarse-surfaced antiskid strips 15 attached to two lengthwise edges of the main support 1, bringing the main support 1 and the sleeve member 2 to locate at the extended or retracted position, and thereby maintaining the back 40 at the adjusted height and distance relative to the seat 50.

In practical applications of the present invention, the locating recesses 21 on the sleeve member 2 are not necessarily limited to a general form of recess, but may be other configurations, such as being provided at a central area of each recess 21 with a small-sized through hole.

What is claimed is:

1. A backrest adjusting mechanism, comprising:

a main support being a hollow tubular member having a first end connected to a lower end of a backrest bracket mounted to a backrest of a chair; said main support being provided at a middle section on a lower surface thereof with a downward projected limiting element, and at the middle section on an upper surface thereof with an elastically upward protruded locating element;

a sleeve member having a first end enclosing said main support and a second end opposite to the first end angularly extended to engage with two lateral sides of a seat bracket mounted below a seat of the chair; said sleeve member being provided at a lower surface of said first end with a lengthwise guide slot for said limiting element to upward extend thereinto to thereby guide said main support and said sleeve member to slide relative to one another; said sleeve member also being provided on an upper surface with a row of lengthwise arranged open-bottom locating recesses, so that said locating element protruded from the upper surface of said main support may elastically slide into one of said locating recesses to hold said main support in place in said sleeve member at an extended or a retracted position relative to said sleeve member; and a locating gear including a shaft having an outer end connected to a turning handle, and an inner end transversely extended through a middle section of said sleeve member; and at least one brake element mounted on a middle section of said shaft; and said brake element being provided at one side with a radially projected press lug;

whereby when said shaft is turned via said turning handle, said press lug of said brake element is driven to firmly press against at least one lengthwise edge of said main support to firmly hold said main support in place at said extended or retracted position relative to said sleeve member.

2. The backrest adjusting mechanism as claimed in claim 1, wherein said locating element is disposed in a cavity formed on a locating seat, said locating element being normally pushed outward by a first elastic element disposed in said cavity behind said locating element; and said locating seat being downward extended to be held in a locating hole provided on the upper surface of said main support.

3. The backrest adjusting mechanism as claimed in claim 1, wherein said limiting element includes a mutually screwed bolt and nut set.

4. The backrest adjusting mechanism as claimed in claim 1, wherein said lengthwise edge of said main support is provided at a position corresponding to said press lug of said brake element of said locating gear with a coarse-surfaced antiskid strip to provide a relatively high friction.

5. The backrest adjusting mechanism as claimed in claim 1, wherein each of said locating recesses formed on said sleeve member is provided at a central area with a through hole.

6. The backrest adjusting mechanism as claimed in claim 1, wherein said main support has a second end opposite to said first end being closed with a cover plate.

7. The backrest adjusting mechanism as claimed in claim 1, wherein said brake element is connected at a surface point to an end of a second elastic element, which is connected at an opposite end to a side wall of said sleeve member near the second end thereof, so as to provide said brake element with a restoring force when said shaft is released.

8. The backrest adjusting mechanism as claimed in claim 1, wherein said locating element is a locating ball.

* * * * *